United States Patent [19]

Strzalko et al.

[11] Patent Number: 4,799,133

[45] Date of Patent: Jan. 17, 1989

[54] ILLUMINATED POINT-OF-SALE SHELF UNIT INSERT

[75] Inventors: Peter Strzalko, Langenfeld; Franz-Josef Walber; Ulrich Wombacher, both of Duesseldorf, all of Fed. Rep. of Germany

[73] Assignee: Henkel Kommanditgesellschaft auf Aktien, Duesseldorf, Fed. Rep. of Germany

[21] Appl. No.: 123,484

[22] Filed: Nov. 20, 1987

[30] Foreign Application Priority Data

Nov. 20, 1986 [DE] Fed. Rep. of Germany ..... 3639687

[51] Int. Cl.[4] ..... F21V 33/00

[52] U.S. Cl. ..... 362/133; 362/26; 362/31

[58] Field of Search ..... 362/26, 31, 32, 132, 362/133, 263, 330

[56] References Cited

U.S. PATENT DOCUMENTS

| | | | |
|---|---|---|---|
| 2,646,637 | 7/1953 | Nierenberg et al. | 362/31 |
| 3,561,145 | 2/1971 | Shotwell | 362/26 |
| 4,223,374 | 9/1980 | Kimmel | 362/31 |

FOREIGN PATENT DOCUMENTS

| | | | |
|---|---|---|---|
| 2722470 | 11/1978 | Fed. Rep. of Germany | 362/31 |
| 2944985 | 5/1981 | Fed. Rep. of Germany . | |
| 611421 | 9/1926 | France | 362/26 |
| 1091225 | 4/1955 | France | 362/31 |
| 291210 | 12/1931 | Italy | 362/263 |
| 952388 | 3/1964 | United Kingdom | 362/31 |

*Primary Examiner*—Michael Koczo
*Assistant Examiner*—Sue Hagarman
*Attorney, Agent, or Firm*—Ernest G. Szoke; Wayne C. Jaeschke; Real J. Grandmaison

[57] ABSTRACT

In a device for inclusion a in point-of-sale shelf unit and for the illumination of sales articles offered, especially in separate surmounted attachments, on the device, the device makes possible the flexible illumination of point-of-sale shelf unit regions while maintaining a planar support surface for the sales articles and without concealing the front edge of the shelf unit. This is attained by providing a substantially parallelepipedonal translucent housing of low height having at least one illuminating body which is arranged inside the region of the front longitudinal side surface and parallelly thereto and which is in part bent backward at right angles into the interior of the housing in the region of laterally adjoining transverse side surfaces of the housing.

11 Claims, 2 Drawing Sheets

ILLUMINATED POINT-OF-SALE SHELF UNIT INSERT

BACKGROUND OF THE INVENTION

1. Field of the Invention:

This invention is directed to a device for inclusion in customary point-of-sale shelf units and for the illumination of sales articles offered, especially in separate surmounted attachments, on the device.

In present customary point-of-sale gondolas or point-of-sale shelf units in department stores and shops, several products of different mode of packaging, different product variants or different manufacturers are often offered, arranged directly one beside the other, for sale to the customer. In such case, the data concerning price and product are often unclear and difficult to find so that the customer must initially take the product out of the point-of-sale shelf unit in order, for example, to be able to find the price. Also, for example special products, which in view of the usual diversity of products set out especially, can be made recognizable in pin-pointed manner for the customer only with special effort because of the usual unitary point-of-sale shelf unit structure.

For the customer, this searching among different sales articles lying one beside the other causes an appreciable loss of time and information. In additiona, the risk frequently exists that the products are not put back at the correct location. The sales person is also often excessively stressed and loses the overview of the location of certain goods and surveys the quantity of goods still standing at disposal only with difficulty. The illumination of point-of-sale shelf units in partial regions thereof in this case creates a facilitation of these problems.

2. Discussion of Related Art:

Known from German patent application No. 29 44 985 is an illuminated point-of-sale shelf unit insert, the head part of which is constructed to be illuminatable. However, this device is entailed by the disadvantage that the head part terminates with the formation of a downwardly directed projection so that indications of price and information, which are disposed at the front side of the shelf unit, are concealed and are no longer viewable, especially for scanning.

It is further known for the illumination of shelf units to mount masked, neon tubes at such units. This has the disadvantage that special illumination effects, possibly characterizing a certain product group, are possible only with very great effort and the width for placing a product is therefore dependent on the length of commercially available neon tubes. Furthermore, nonilluminated regions occur at the gaps between neon tubes placed in a row one against the other. This mode of illumination, also, is not suitable for scanning and obstructs the removal of goods from the otherwise planar region of the point-of-sale shelf units.

An object of this invention is the provision of a solution which makes possible the flexible illumination of point-of-sale shelf unit regions while maintaining a planar support surface and without concealment of the shelf unit front edge.

DESCRIPTION OF THE INVENTION

Other than in the operating examples, or where otherwise indicated, all numbers expressing quantities of ingredients or reaction conditions used herein are to be understood as modified in all instances by the term "about".

In a device of the afore-mentioned kind, these problems are solved according to the invention by a substantially parallelepipedonal translucent housing of low height having at least one illuminating body which is located inside the region of the front longitudinal side surface and parallelly thereto and which is in part bent backward at right angles into the interior of the housing in the region of the laterally adjoining transverse side surfaces of the housing.

Pursuant to the device according to the invention, point-of-sale units are illuminatable in regions without price or information shields arranged in the region of the front edge of the shelf unit being concealed. Equally, a planar support surface is also present in the shelf unit equipped with the device according to the invention. Individual separate inserts, into which the products to be offered are set, can be placed on the device according to the invention. The length of the device may be structured in accordance with the desired number of sales articles to be offered one beside the other and corresponding to the desired placement width in the shelf unit. The width of the device should correspond to the depth of customary point-of-sale shelf units.

By reason of the right-angled bending away of the illuminating body in the region of the transverse side surfaces towards the interior of the housing, fewer poorly illuminated regions are obtained in the region of the gaps when several devices are placed one against the other.

Furthermore, the invention provides that the illuminating body is constructed as a neon tube. Neon tubes have the advantage that they can also be developed in various colors and are manufacturable in desired lengths.

In one embodiment, the invention provides that the parallelepipedonal housing is assemblable from several individual bodies which are of equal length and height and matched one to the other in modular manner, into a unitary point-of-sale shelf unit insert having a planar support surface.

By reason of this embodiment, the device is easily transporttable and flexibly adaptable to different shelf unit depths. Different individual bodies may be placed one against the other in accordance with the depth of the shelf unit.

A simplified handling, maintenance and cost-effective production of the device is made possible when only one of the individual bodies displays an illuminating body, as is furthermore provided by the invention.

To assure the secure insertion one into the other of the individual bodies, the invention provides an expedient further embodiment wherein the individual bodies in the region of their upper and/or lower side have depressions in at least a region thereof and/or have connecting tongues which protrude at the oppositely disposed longitudinal side and which are constructed to correspond with the depressions.

The invention is further distinguished whereby at least the individual body which is provided with an illuminating body is produced of a translucent synthetic material.

In order to be able to fill the depth of a conventional point-of-sale shelf unit with the lowest possible number of individual bodies, the invention also provides a refinement in the sense of a modular mode of construction in that the individual bodies are matched one to the other as to their width in such a manner that they, individually or in combination, exactly fill out the depth of a customary point-of-sale shelf unit.

Finally, the invention also contemplates openings in the longitudinal side surfaces of the individual bodies which are not provided with the illuminating body for the feeding-through of electrical connections.

The invention is described in more detail by way of example in the following with reference to the drawings.

DETAILED DESCRIPTION OF THE DRAWINGS

Figure 1:
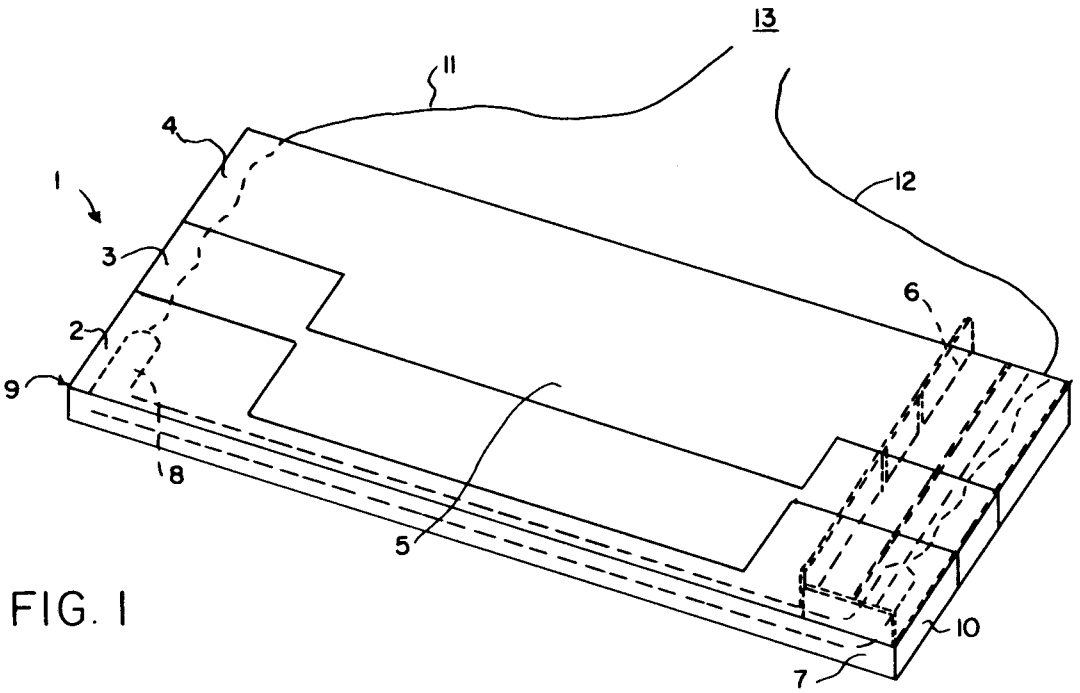
FIG. 1 is a perspective plan view of a device according to the invention illustrating a separate surmounted attachment.

FIG. 1 shows a substantially parallelepipedonal translucent housing device 1, which is assembled from three individual bodies 2, 3 and 4. The individual bodies 2, 3 and 4 are matched one to the other in such a way that a continuous planar support surface 5 results on the upper side of the housing. Several separate surmounted attachments 6, one of which is indicated in dashed lines, for the reception of the sales articles to be offered can be arranged on this support surface.

Arranged on the inside in the region of the front longitudinal side surface 7 and parallelly thereto is an illuminating body 8, which is drawn in dashed lines, and which in the region of the transverse side surfaces 9 and 10 is bent back at right angles in a direction towards the interior of the housing. The illuminating body is adapted for connection with a voltage source 13 by way of electrical connections 11 and 12. A small diameter neon tube may be employed as the illuminating body 8.

The housing of device 1 has an overall height of about 2 to 3 centimeters. In the case of the illustrated embodiment, only individual body 2, which in the position of use in the point-of-sale shelf unit faces the viewer, is equipped with an illuminating body 8. The device 1 is introduced into a point-of-sale shelf unit in such a manner that the front longitudinal side surface 7 is aligned with the front wall of the shelf unit. It is of course also possible to provide several of the individual bodies with one or more illuminating bodies. At least the individual body 2 is produced of a translucent material, especially synthetic material. Advantageously, all individual bodies 2, 3 and 4 are produced of such a material so that the device 1 appears as a unitary luminant body when the illuminating body 8 is switched on.

Figure 2:
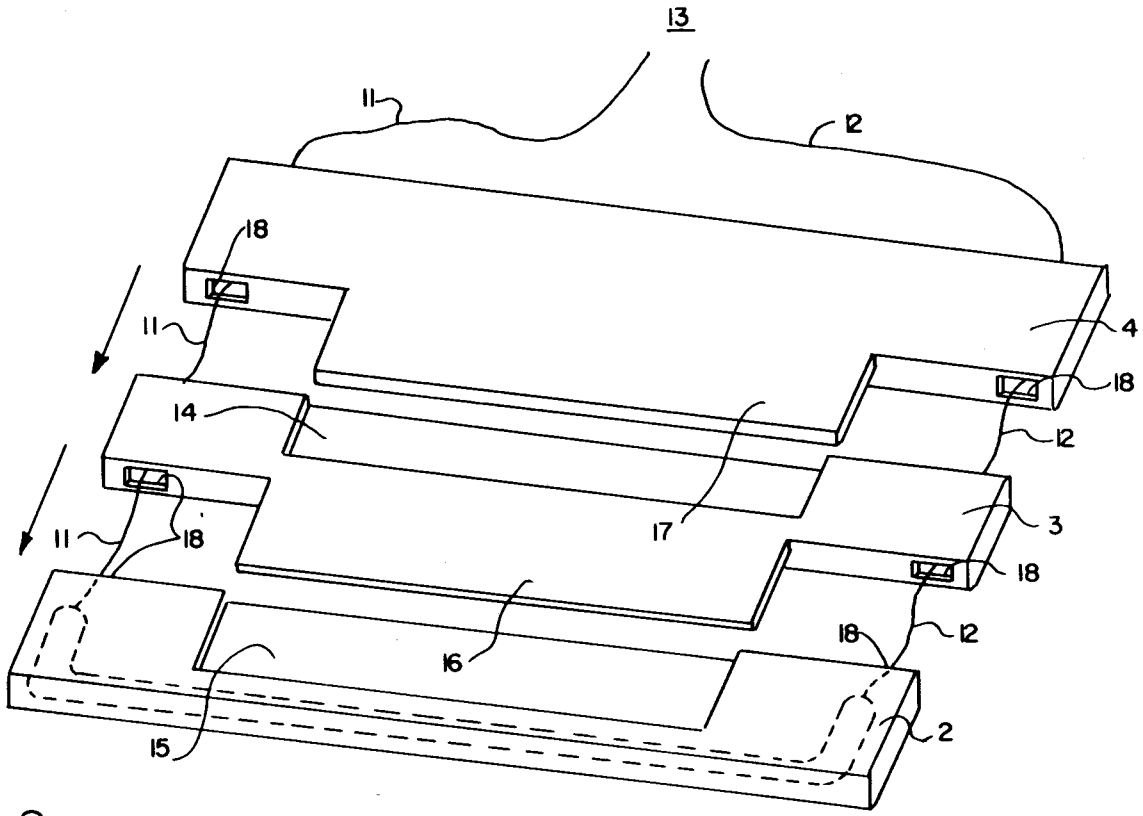
FIG. 2 illustrates a device according to the invention wherein three individual bodies are in a drawn-apart state.

In the exploded illustration of the device 1 in FIG. 2, regional depressions 14 and 15 in the individual bodies 3 and 2 as well as connecting tongues 16 and 17 corresponding therewith from individual bodies 3 and 4 may be seen therein. The longitudinal side surfaces concealed to the observer have openings 18 for the feeding-through of electrical connections 11 and 12.

The regional depressions 14 and 15 as well as the connecting tongues 16 and 17 to be received therein are matched one to the other so that a continuous planar support surface results after the individual bodies 2, 3 and 4 are pushed one against the other as shown in FIG. 1. Furthermore, the individual bodies 2, 3 and 4 are matched one to the other in their width in such a manner than they, individually or in combination, exactly fill the depth of a conventional point-of-sale shelf unit. It is thus possible that the whole device 1 may also consist of only one individual body.

The described device may of course be modified or supplemented in various ways without departing from the basic concept of the invention. For example, illuminating body 8 may also be a fluorescent tube or consist of individual illuminating bodies such as incandescent bulbs arranged in the inside region of side surfaces 7, 9 and 10.

What is claimed is:

1. A device for inclusion in a point-of-sale shelf unit and for the illumination of sales articles offered on the device, comprising a substantially parallelepipedonal translucent housing of low height having at least one illuminating body which is located inside the region of the front longitudinal side surface and parallel thereto and which is in part bent backward at right angles into the interior of said housing in the region of laterally adjoining transverse side surfaces of said housing, said housing being assemblable in modular manner into a unitary unit having a planar support surface from individual bodies which are of equal length and height and matched one to the other, wherein said individual bodies in the region of their upper or lower side have depressions in at least a region thereof or have connecting tongues which protrude at the oppositely disposed longitudinal side and which are constructed to correspond with said depressions.

2. A device according to claim 1 wherein said illuminating body is constructed as a neon tube.

3. A device according to claim 1 wherein said individual bodies are matched one to the other in their width in such a manner that they, individually or in combination, exactly fill the depth of a conventional point-of-sale shelf unit.

4. A device according to claim 1 wherein said individual bodies have openings in the longitudinal side surfaces thereof for the feeding-through of electrical connections.

5. A device for inclusion in a point-of-sale shelf unit and for the illumination of sales articles offered on the device, said device comprising separable individual bodies in the form of a substantially parallelepipedonal translucent housing having a low height and having at least one illuminating body which is located inside the region of the front longitudinal side surface of said housing and parallel thereto, wherein said illuminating body is partially bent backward at right angles into the interior of said housing in the region of laterally adjoining transverse side surfaces of said housing, said housing being assemblable in modular manner into a unitary unit having a planar support surface from said individual bodies, said individual bodies having an equal length and height and being matched one to the other, wherein said individual bodies in the region of their upper or lower side have depressions in at least a region thereof or have connecting tongues which protrude at the oppositely disposed longitudinal side and which are constructed to correspond with said depressions.

6. A device according to claim 5 wherein said illuminating body is constructed as a neon tube.

7. A device according to claim 5 wherein said support surface is provided with at least one separate surmounted attachment for the reception of said sales articles.

8. A device according to claim 5 wherein each of said individual bodies has an illuminating body.

9. A device according to claim 5 wherein said individual bodies are matched one to the other in their width in such a manner that they, individually or in combination, exactly fill the depth of a conventional point-of-sale shelf unit.

10. A device according to claim 5 wherein said individual bodies have openings in the longitudinal side surfaces thereof for the feeding-through of electrical connections.

11. A device according to claim 5 wherein said housing has an overall height of about 2 to 3 centimeters.

* * * * *